United States Patent [19]

Bradley

[11] Patent Number: 4,555,748

[45] Date of Patent: Nov. 26, 1985

[54] TRUNCATED MOTOR VEHICLE HEADLAMP

[75] Inventor: Irving Bradley, Russell Township, Geauga County, Ohio

[73] Assignee: General Electric Company, Schenectady, N.Y.

[21] Appl. No.: 693,816

[22] Filed: Jan. 22, 1985

Related U.S. Application Data

[63] Continuation of Ser. No. 437,424, Oct. 28, 1982, abandoned.

[51] Int. Cl.[4] ..... F21V 29/00; F21V 7/00

[52] U.S. Cl. ..... 362/61; 362/294; 362/296; 362/345; 313/113

[58] Field of Search ..... 362/61, 373, 83, 294, 362/296, 345, 346, 349, 351; 313/17, 33, 44, 45, 41, 113, 636

[56] References Cited

U.S. PATENT DOCUMENTS

| | | | |
|---|---|---|---|
| 1,365,319 | 1/1921 | Hazard | 362/349 |
| 3,657,588 | 4/1972 | McRae | 313/113 |
| 3,688,149 | 8/1972 | Pitkjaan | 362/346 |
| 4,208,704 | 6/1980 | Draper | 362/350 |
| 4,210,841 | 7/1980 | Vodicka et al. | 313/113 |
| 4,219,871 | 8/1980 | Larrimore | 362/294 |
| 4,276,583 | 6/1981 | Fratty | 362/346 |
| 4,280,173 | 7/1981 | Bradley et al. | 362/294 |
| 4,316,240 | 2/1982 | Pitkjaan | 362/61 |
| 4,344,120 | 8/1982 | Bradley et al. | 362/61 |
| 4,351,018 | 9/1982 | Fratty | 362/346 |
| 4,390,935 | 6/1983 | Audesse et al. | 362/296 |

FOREIGN PATENT DOCUMENTS

| | | | |
|---|---|---|---|
| 2239646 | 7/1973 | France | 362/294 |
| 656948 | 10/1963 | Italy . | |
| 310628 | 5/1969 | Sweden | 362/294 |
| 1118017 | 6/1968 | United Kingdom | 362/345 |
| 2069123 | 8/1981 | United Kingdom | 362/350 |

*Primary Examiner*—Ira S. Lazarus

*Attorney, Agent, or Firm*—J. F. McDevitt; Philip L. Schlamp; Fred Jacob

[57] ABSTRACT

An improved vehicle lamp for forward illumination, such as a headlamp or fog lamp is provided which is substantially devoid of upward directed glare light and which is formed with a synthetic organic polymer material. Heat shield means are disclosed for said vehicle lamp to prevent heat distortion otherwise occurring at the lamp roof by reason of its proximity to the light source used. Said heat shield means can be provided as an integral portion of the lamp roof when molded and further include heat transfer means to dissipate heat from the internal lamp envelope.

6 Claims, 4 Drawing Figures

TRUNCATED MOTOR VEHICLE HEADLAMP

This application is a continuation of application Ser. No. 437,424 filed Oct. 28, 1982, now abandoned.

RELATED APPLICATION

In U.S. patent application Ser. No. 386,498, filed June 9, 1982, and assigned to the assignee of the present invention, there is disclosed a truncated motor vehicle headlamp having a concave reflector truncated at its top and bottom, one of the truncated surfaces being closer to the optical axis than to the other truncated surface, and which is devoid of upward directed glare light when operated. Said lamp construction is particularly useful in automotive vehicles desiring aerodynamic styling by reason of having a lower profile due to a reduced horizontal width. In said vehicle lamp there is included a concave reflector truncated at opposite sides thereof to provide two generally flat sections substantially parallel to each other and to the optical axis of a curved portion of the reflector, a light source contained within said reflector, and one of said generally flat sections being substantially closer than is the other to said optical axis, said lamp being devoid of any light shield between said light source and said curved portion of the reflector. The present invention represents a further improvement in providing particular light shield means for said lamp construction.

BACKGROUND OF THE INVENTION

Heat shield means are already known for use in all-plastic headlamps having a rectangular construction such as described in U.S. Pat. Nos. 4,280,173 and 4,210,841, both assigned to the assignee of the present invention. In said earlier issued patent, the disclosed heat shield means comprises a metal disc interposed between the lamp filament and the lamp roof. The flat surfaces forming the roof and floor of the truncated reflector are generally parallel to each other and located at the same distance from the lamp optical axis. In the subseqently issued aforementioned patent, the heat shield means is again interposed between the light source filament and the lamp roof by having a substantially planar heat reflecting member suspended from the lamp roof. The function achieved with both type heat shield means is to prevent convection and radiation heating by the lamp filament producing wall temperatures in the region above the filament approaching or exceeding the softening temperature of the plastic.

It would be desirable to provide the same benefit in a lamp construction of this general type but which has too little free space above the lamp filament to accommodate interposition of separate heat shield means. More particularly, the lower profile truncated motor vehicle lamp disclosed in the aforementioned Ser. No. 386,498 application is of such reduced horizontal width that the roof surface of the reflector member is in much closer proximity to the lamp filament so that it is not possible to interpose heat shield means therebetween. While an all-glass construction of said prior art headlamp can eliminate heat distortion problems, it will be appreciated that convection and radiation heating of the roof surface in this headlamp is a far more serious problem than encountered in the prior art all-plastic PAR lamps. Accordingly, an all-plastic headlamp with the configuration disclosed in said aforementioned pending application requires both a relocation of the heat shield means along with a more effective means to prevent heat distortion of the lamp roof.

It is an important object of the present invention, therefore, to provide an all-plastic PAR lamp for vehicle illumination of the low profile rectangular type with effective heat shield means.

It is another important object of the invention to provide heat shield means for all-plastic headlamps of this type which further includes more effective means to remove heat from the interior lamp envelope.

A still further object of the present invention is to provide said heat shield means as an integral part of the reflector roof when molded.

SUMMARY OF THE INVENTION

Briefly, the present improvement resides in having the heat shield means form an integral part of the flat roof section of the reflector member in this type plastic headlamp. In a preferred embodiment, a metal insert is located in the flat roof surface directly above the filament in the light source and which is secured in place when the plastic reflector member is molded. By further providing said metal insert with additional heat transfer means, such as with cooling fins or corrugations, there is produced still better heat removal from the internal lamp envelope to avoid physical distortion which can lead to premature lamp failure from ambient moisture penetration.

The present invention thereby comprises an improved vehicle headlamp for forward illumination substantially devoid of upwardly direct glare light comprising a concave reflector truncated at opposite sides thereof to provide two generally flat sections substantially parallel to each other and to the optical axis of a curved portion of the reflector, a filament light source being enclosed within a bulb and contained within said reflector, and one of said generally flat sections being substantially closer than is the other to said optical axis wherein the improvement comprises having said reflector formed with a synthetic organic polymer and having heat shield means forming a part of the flat section closer to the light source. As previously indicated, the preferred lamp embodiment has said reflector member molded with a synthetic organic polymer and further includes the metal heat shield means being molded into the flat section closer to the light source. An alternate method to bond the metal heat shield means to the reflector member can use structural adhesives.

DESCRIPTION OF THE PREFERRED EMBODIMENTS

Figure 1:
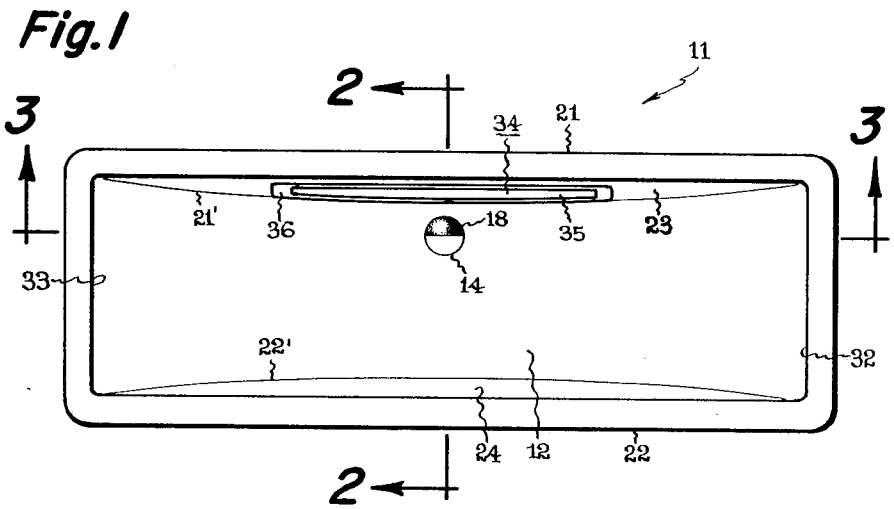
FIG. 1 is a front view of a headlamp in accordance with the preferred embodiment of the invention.
Figure 2:
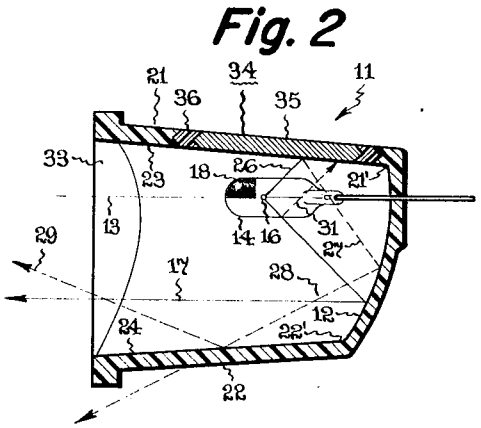
FIG. 2 is a side sectional view taken on the line 2—2 of FIG. 1.
Figure 3:
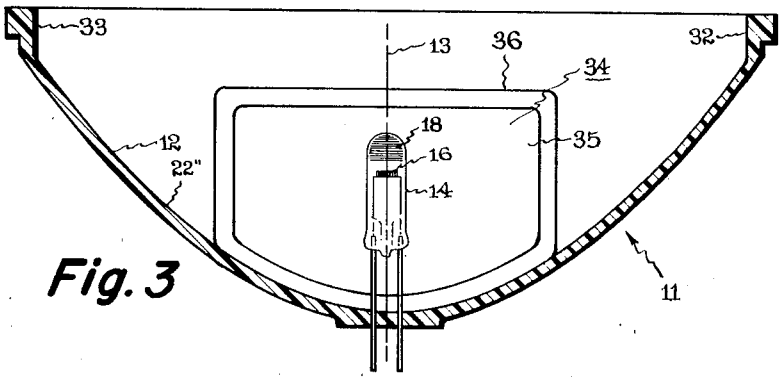
FIG. 3 is a horizontal sectional view taken on the line 3—3 of FIG. 1.

A representative truncated motor vehicle headlamp of all plastic construction incorporating the improved heat shield means according to the present invention comprises a reflector 11 having a generally parabolic or other concave reflecting surface 12 which may be a true parabola or a modified parabola configuration having an optical axis 13. A light bulb 14, preferably of the glass-halogen type, is held in the reflector 11 by conventional or other suitable means, and contains a filament 16 or other suitable light source at or near the optical axis 13 and also at or near the focal point of the reflector 12 so that the reflector 12 will reflect light from the light source 16 in the desired forward direction as exemplified by a reflected light ray 17. If desired, the front top half of the bulb 14 may be rendered opaque, such as with a coating 18 of dark material, to block light rays that would emanate directly through the lens at an upward angle above the horizontal axis 13. The top and bottom parts of the reflector 11 are truncated to form substantially flat top and bottom sections 21 and 22 which may both be parallel to the optical axis 13. A transparent cover plate or lens (not shown) also of synthetic organic polymer material can be attached over the front opening of the reflector in the conventional manner. One of the flat sections, such as the top section 21, is considerably closer to the optical axis 13 than is the other flat section 22 whereby reflecting surface 12 is approximately a half section, or slightly wider, of the more conventional symmetrical parabolic reflector. It provides more accurate beam design control of the reflected beam pattern and achieves substantial reduction of undesirable glare light above horizontal by eliminating the conventional parabolic upper half reflecting surface which, if present, would cause some glare light having an upward directional component. The light source 16 should be frontwardly of the junction lines 21' and 22' between the flat sections 21 and 22 and the parabolic section 12, at least in the vicinity 22" of the vertical plane in which the light source lies, to prevent glare rays caused by light reflected from inner surface areas of the bulb, frontwardly of the light source, and re-reflected by the parabolic reflector surface. To further enhance glare-free illumination by said lamp construction, one or both of the top and bottom sections 21 and 22 can be made so as not to reflect light. This can be accomplished by making them transparent, or of a light-absorbing polymer material, or coating them, preferably at the inner surfaces 23 and 24 with a dark non-reflector material such as paint. The terms "non-reflective" and "substantially non-reflective" as used herein mean that a surface has a low reflectivity source to reduce glare in accordance with the desired objective, it being recognized that it is difficult or impossible to achieve absolutely zero reflectivity of the surface.

As has been indicated, parabolic reflecting surface 12 reflects light rays from the light source 16 in a desired frontward direction and, if desired, can be contoured to reflect some light downwardly and frontwardly to illuminate the road near the vehicle, and with none of this reflected light having a significant upward component to cause glare for oncoming motorists. Also some light from the light source 16 will project directly frontward and downward through the front lens of the headlamp adding to the nearby road illumination but not causing glare. The opaque coating 18 on the front of the light bulb blocks and prevents direct glare light rays. Some light rays 26 from the source 16 are at an upward and rearward angle, and are not reflected by the non-reflector surface 23 because it is absorbed by the dark color or because it passes through a transparent truncated section 21 and becomes trapped or absorbed by the vehicle hood or other structural member. If, however, light rays 26 were reflected at surface 23, they would follow a path 27, be re-reflected by surface 12 into a path 28, and again be re-reflected by surface 24 (if reflected) into a path 29 frontwardly and upwardly from the headlamp thus causing undesired glare to oncoming motorists. There would be an infinite number of such undesired glare rays, reflecting at diverging angles, i.e., "fanning out" and scattering from the surfaces 23 and 24 and causing a wide spreading projector beam of light having undesirable upward glare component. Also, light rays reaching the front region of the lower surface 24 directly from the light source 16 would, if this surface were reflective, be reflected with a glare-producing upward component. Thus, by providing non-reflective characteristics at the truncated sections 21 and 22, there is prevented or substantially reduced any glare light. Numeral 31 indicates a light ray reflected by the inner surface of the light bulb 14 in an upward and rearward direction similar to the just-described ray 26, and which is not reflected by the truncated areas 21 and 22; if these areas were reflective, the ray 31 and others generally in the same direction would be multiply reflected and emerge as glare rays similar to ray 29. In said depicted lamp embodiment, the sides 32 and 33 of the reflector can be truncated, if desired, to reduce the horizontal width, and may be either reflective or non-reflective because sideways (but not upward) reflected rays are relatively unimportant. Also, the light bulb 14 although shown horizontal can be vertical or at another angle with the opaque coating area 18, if provided, being relocated on the bulb to block direct frontward light rays that would have an upward component to the front of the headlamp.

As also previously indicated, the present improvement resides in providing heat shield means 34 as an integral part of the flat reflector section 21 closer to the light source in said lamp embodiment. More particularly, incorporation of the heat shield member itself in said plastic material at a location preferably right above the lamp filament not only averts softening of the plastic at said location but further provides means to dissipate this heat from the inside of the lamp envelope. A planar metal disc 35 can serve as the heat shield member by reason of exhibiting a higher melting point together with higher thermal conductivity than available in the thermoplastic organic materials employed to mold the plastic reflector member. The further ability of said metal disc 35 to conduct heat laterally through the surrounding plastic material as well as to the ambient atmosphere, however, can be ameliorated by interposing heat insulation 36 of a higher melting point synthetic resin as an integral part of the reflector member when molded in a preferred embodiment of the present improved heat shield means.

Suitable thermoplastic organic polymers for use in molding the present reflector member can be selected from the class of transparent or opaque thermoplastic resins exhibiting a heat distortion temperature in excess of 130° C. and which include polycarbonate copolymers, such as sold under the trade name "Lexan" by General Electric Company, as well as polysulfones, filled phenolic resins, polyether imides, and polyphenylene sulfide resins. As representative of suitable higher melting point thermoplastic resins suitable for barrier insulation in the present improved heat shield means there can be selected commercially available polyphenylene sulfides having heat distortion temperatures of 260° C. and greater as well as phenolic thermosets having a heat distortion temperature of at least 180° C.

Figure 4:
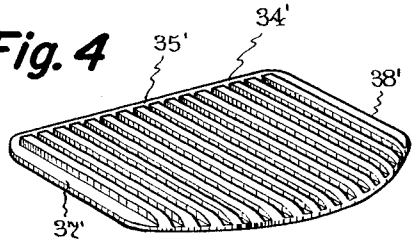
FIG. 4 depicts a preferred heat shield member with cooling fins.

In FIG. 4 there is depicted an especially preferred heat shield member for use in accordance with the present invention having edges for attachment to the roof of the plastic reflector as well as additional cooling structure to remove heat from the inside of the lamp envelope. Specifically, said metal heat shield member 34' is in the form of a planar disc 35' with a contour suitable to fit into the opening provided in said reflector roof and having edge tabs 37' and 38' for engagement with slots provided in the sides of said opening. A series of parallel aligned ribs 39' are provided on the exterior of said planar disc in order to help remove heat from the enclosed reflector rather than conduct this heat laterally to the adjacent plastic material.

It will be apparent from the foregoing description that the present improved heat shield means can be modified other than herein specifically disclosed without departing from the true spirit and the scope of the present invention. For example, it is contemplated that the metal heat shield member can have different shapes such as circular as well as be enlarged to form part of the rear curved surface of said reflector member. Accordingly, it is intended to limit the present invention only by the scope of the following claims.

What I claim as new and desire to secure by United States Letters Patent is:

1. An improved vehicle headlamp for forward illumination substantially devoid of upwardly directed glare light comprising a concave parabolic enclosed reflector truncated at opposite sides thereof to provide top and bottom flat sections substantially parallel to each other and to the optical axis of a curved portion of the reflector, both of said top and bottom sections being non-reflective and with said top section being substantially closer to said optical axis than said bottom section, a single filament light source contained within said reflector, said light source being enclosed within a bulb, said filament also being devoid of shield means blocking its light rays from being projected to the curved portion of the reflector member, and said light source being positioned substantially on said optical axis and frontwardly of the junctions of said generally flat truncated sections with the reflecting section of the reflector at least in the vicinity of the vertical plane in which the light source lies, wherein the improvement comprises having said reflector formed with a thermoplastic synthetic organic polymer and having a planar metal member forming a part of the flat section above the light source which removes heat from the enclosed reflector member.

2. An improved vehicle lamp as in claim 1 wherein said planar metal member further includes heat insulation means located at the polymer and metal junction.

3. An improved vehicle headlamp for forward illumination substantially devoid of upwardly directed glare light comprising a concave parabolic enclosed reflector truncated at opposite sides thereof to provide top and bottom flat sections substantially parallel to each other and to the optical axis of the curved portion of the reflector, both of said top and bottom sections being non-reflective and with said top section being substantially closer to said optical axis than said bottom section, and a single filament light source contained within said reflector, said filament also being devoid of shield means blocking its light rays from being projected to the curved portion of the reflector member, said light source being enclosed within a bulb, said light source being positioned substantially on said optical axis and frontwardly of the junctions of said generally flat truncated sections with the reflecting section of the reflector at least in the vicinity of the vertical plane in which the light source lies, and said headlamp being devoid of any light shield between said light source and said curved portion of the reflector wherein the improvement comprises having said reflector molded with a thermoplastic synthetic organic polymer and having a planar metal member molded into the top section above the light source which removes heat from the enclosed reflector member.

4. An improved vehicle lamp as in claim 3 wherein said planar metal member further includes heat dissipation rib elements.

5. An improved vehicle lamp as in claim 4 wherein said planar metal member comprises a corrugated metal member.

6. An improved vehicle lamp as in claim 3 which further includes heat insulation means located at the polymer and metal junction.

* * * * *